US008424473B1

(12) United States Patent
Mandall

(10) Patent No.: US 8,424,473 B1
(45) Date of Patent: Apr. 23, 2013

(54) BLAST ENERGY ABSORBING SECURITY DOOR PANEL

(76) Inventor: Michael C. Mandall, Phoenix, AZ (US)

( * ) Notice: Subject to any disclaimer, the term of this patent is extended or adjusted under 35 U.S.C. 154(b) by 461 days.

(21) Appl. No.: 12/770,551

(22) Filed: Apr. 29, 2010

(51) Int. Cl.
*E05B 9/00* (2006.01)

(52) U.S. Cl.
USPC ..... 109/49.5; 109/26; 109/65; 109/82

(58) Field of Classification Search ..... 70/26–28, 70/49.5, 58, 64, 65, 76, 80, 82–85; 109/26–28, 109/49.5, 58, 64, 65, 76, 80, 82–85
See application file for complete search history.

(56) References Cited

U.S. PATENT DOCUMENTS

| | | | | |
|---|---|---|---|---|
| 2,552,515 | A | 5/1951 | Bremer | |
| 3,645,216 | A * | 2/1972 | Radford et al. | 109/82 |
| 3,901,124 | A * | 8/1975 | Hausenblas | 109/49.5 |
| 3,969,563 | A | 7/1976 | Hollis, Sr. | |
| 4,178,859 | A | 12/1979 | Seiz et al. | |
| 4,442,780 | A * | 4/1984 | Child | 109/29 |
| 4,727,789 | A | 3/1988 | Katsanis | |
| 4,926,761 | A * | 5/1990 | Haesebrouck | 109/49.5 |
| 5,060,582 | A | 10/1991 | Salzer et al. | |
| 5,272,954 | A | 12/1993 | Crouch | |
| 5,471,905 | A * | 12/1995 | Martin | 109/49.5 |
| 5,654,518 | A * | 8/1997 | Dobbs | 109/49.5 |
| 5,660,021 | A | 8/1997 | Wolgamot et al. | |
| 6,240,858 | B1 | 6/2001 | Mandall | |
| 6,363,867 | B1 * | 4/2002 | Tsilevich | 109/49.5 |
| 7,000,550 | B1 | 2/2006 | Mandall | |
| 7,415,806 | B2 * | 8/2008 | Davidson | 109/49.5 |
| 7,740,931 | B2 * | 6/2010 | Keller et al. | 109/65 |
| 7,926,407 | B1 * | 4/2011 | Hallissy et al. | 109/49.5 |
| 8,037,802 | B2 * | 10/2011 | Ciriscioli et al. | 109/58 |

* cited by examiner

*Primary Examiner* — Christopher Boswell
(74) *Attorney, Agent, or Firm* — James L. Farmer

(57) ABSTRACT

Methods and apparatus are provided for a blast resistant door assembly having a front surface exposed to potential explosive attack, the door assembly comprising a stack of alternating front and rear elongated flat plates, the front plates offset to the front of the panel relative to the rear plates such that only a portion of the front and rear plates overlap. A series of tension rods extends through stacked assembly, and compresses the assembly together. The door assembly may be used alone or in combination with another blast resistant panel of a different construction.

34 Claims, 7 Drawing Sheets

BLAST ENERGY ABSORBING SECURITY DOOR PANEL

TECHNICAL FIELD

The present invention generally relates to preventing unauthorized entry into secure areas, and more particularly to penetration resistant panels designed to resist multiple explosive attacks.

BACKGROUND

Inventors have long been concerned with devising penetration resistant panels to serve as doors for safes, vaults, and the like. A more-or-less conventional approach to penetration resistance is to pack the interior of the panel with layers of tough materials, such as, metal screen, ceramic, gypsum and mineral fibers. This is the approach advocated by U.S. Pat. No. 5,060,582 granted Oct. 29, 1991 to H. Salzer for "High Security Blast Resistant Door Leaf".

A more sophisticated approach was suggested in U.S. Pat. No. 6,240,858 granted Jun. 5, 2001 to M. C. Mandall for "Penetration Resistant Panel". In this patent the panel contains a plurality of elongated members in a serpentine configuration under axial compression. The serpentine members are biased to straighten and extend into an opening that is cut or blasted through the panel.

While these prior art approaches to penetration resistance are somewhat effective, there continues to be a need for an improved penetration resistance panel which is particularly effective in resisting not just one, but repeated explosive attacks. Existing systems are generally considered effective at resisting an initial explosive attack in so far as stopping an attacker from completely breeching the barrier. However the initial attack produces damage, typically leaving the internal structural members of the barrier exposed to some degree and considerably more vulnerable to additional explosive attacks. Accordingly a need exists for a panel that can survive multiple attacks without exposing internal structural members to direct attack.

In addition, with door systems involving active internal elements, such as for example the system disclosed in the '858 patent to Mandall, resisting more than one explosion requires that the internal door elements remain free to straighten and fill a hole caused by an initial explosion. The outer skin of such door panels is typically a relatively thin plate selected to minimize the potential for itself deforming into and restraining the active internal elements. A problem with such systems however, is that the need for a relatively thin outer skin conflicts with the desire to minimize the area of the inner door exposed after an explosive attack. Thus a need exists for a barrier capable of providing a significant degree of resistance to an initial explosive attack without itself damaging or encroaching upon neighboring blast resistant elements.

BRIEF DESCRIPTION OF THE DRAWINGS

The present invention will hereinafter be described in conjunction with the following drawing figures, wherein like numerals denote like elements, and wherein.

DETAILED DESCRIPTION

Figure 1:
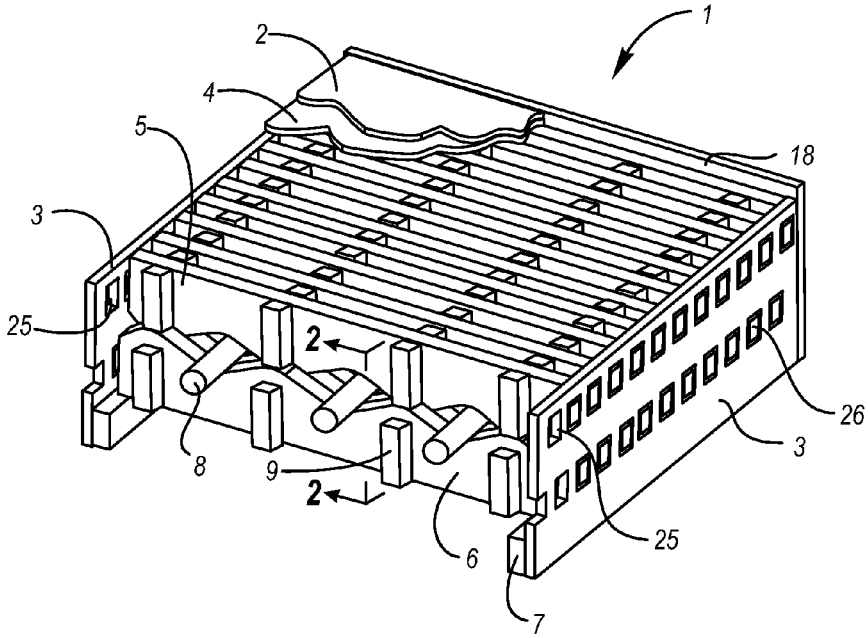
FIG. 1 is a perspective view of a door panel according to the present invention with sinusoidal shaped internal spar edges.

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Door Panel Construction

The door panel and frame shown in FIGS. 1-4 is a stacked plate construction indicated generally by reference numeral 1 and comprised of a front skin 2, side frames 3, a series of front spars 5, a series of rear spars 6, a series of vertical tension rods 8, and a series of spacer blocks 9. These components are preferably welded together to form the structural body of the door panel.

The front and rear spars 5, 6 are preferably elongated flat steel plates oriented with their flat sides facing one another, and narrow edges facing front and back. Preferable spar material qualities include high strength for resisting the pressures and loads present in close proximity to an explosive event, and an ability of the material to retain its shape after significant deformation. For example, in one preferred embodiment the spars are made of an armor steel alloy such as MIL-A-12560, or MIL-A-4600. The spar depth (front-to-back) and thickness (top-to-bottom) are generally sized to match the explosive threat it is designed to defeat.

The front skin 2 is also preferably a flat steel plate, and meant to present a continuous physical barrier of sufficient hardness and strength to slow attacks utilizing all forms of cutting and hand tools. Front skin 2 in addition acts as a connecting member for each of the individual front spars 5. Rows of horizontal slots 10 in skin 2 receive tabs 11 on the forward edge of front spars 5 to locate the spars 5 with respect to the skin 2 and provide a joint for welding. In one preferred embodiment tabs 11 and corresponding slots 10 are provided only on every other front spar.

The ends of spars 5 and 6 are attached to side frames 3 which are also preferably fabricated from high strength steel plate. A series of slots 25 are provided in frames 3 for receiving end tabs 26, with the tabs and slots again providing a convenient joint for welding the components together. Beams 7 are attached to the inside surfaces of the frames 3 behind the ends of rear spars 6, lending additional support to the ends of the panel. The door panel is preferably installed in an opening such that the side frames 3 and beams 7 abut jambs 27. In the event of an explosive breeching attack, the force imparted to the front of the panel is thus carried through the spars to the side frames 3 and beams 7, and reacted against the jambs 27.

Figure 2:
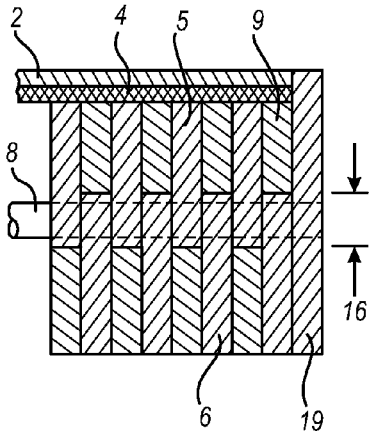
FIG. 2 is a cross section of a portion of the door panel of FIG. 1 taken through the spacer blocks in an overlap region.
Figure 3:
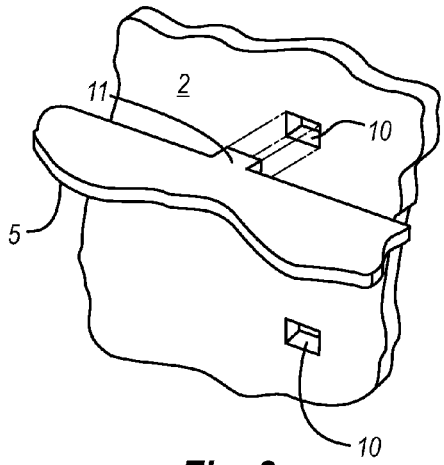
FIG. 3 is a cut-away perspective view of a portion of a front spar the front skin.
Figure 7:
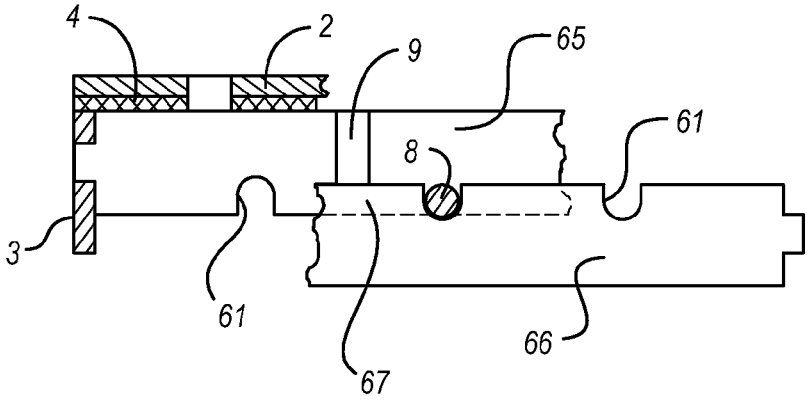
FIG. 7 is a partially cut-away top view of the panel of FIG. 6.

Referring to FIGS. 2 and 7, the door panel may further include one or more optional composite layers 4 directly behind the front skin 2 for presenting a breech resistant barrier specific to an individual or set of non-explosive attach techniques such as torches, abrasive saws, drills, etc. This feature is dictated by the specific requirements of the door system to resist attack techniques other than explosives. The placement of the composite layer 4 further helps to limit the effectiveness of the first explosive event by decoupling and reducing the shock wave transmission from the outer skin 2 through to the front spars 5. The composite layer 4 may comprise various materials such as plywood, fiberglass, or rubber composites.

The door panel of the present invention is constructed in such a way as to present a physical barrier to the passage of an attacker even after a series of explosive charges have been detonated on the panel's outer surface in an attempt to produce a man sized hole. As will be described further below, the unique interleaved spar construction is designed to absorb the energy of such explosive charges while limiting rearward displacement of the back surface of the door panel.

Figure 4:
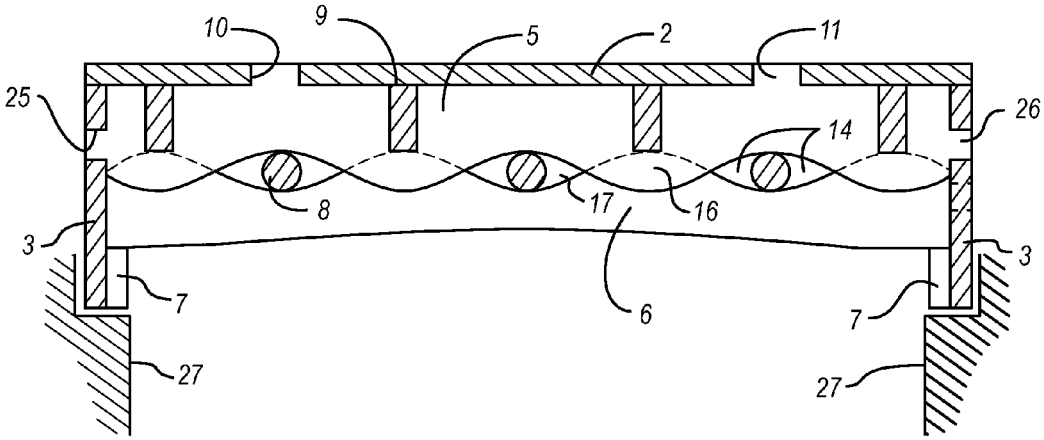
FIG. 4 is a top view of the door panel of FIG. 1.

Referring again to FIGS. 1-3, spars 5 and 6 are stacked in an alternating, interleaved arrangement, with the front spars 5 offset toward the front of the panel relative to the rear spars 6. The forward edges of front spars 5 and skin 2 define the front surface of the door panel, and rear edges of the rear spars define a back surface. A spar overlap region 16 is indicated on FIG. 2. The spar overlap region 16 occurs intermittently and is the result of the sinusoidal contour in the front edge of the rear spars 6 and the back edge of the front spars 5. As shown in FIG. 4, the sinusoidal contours are out of phase such that they combine to define overlap regions 16 alternating with open spaces 17. The amount of overlap varies across each overlap region from zero at the ends of the overlap region to a maximum at the center of the region, with the maximum approximately equal to the width of rods 8. Likewise the open spaces 17 are elongated with a maximum width at the center of each open space preferably equal to the width of the tension rods 8.

Figure 5:
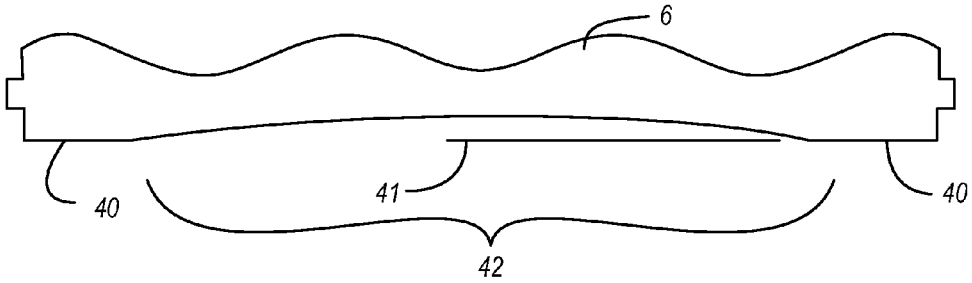
FIG. 5 is a planform view of a rear spar with a sinusoidal shaped front edge.

The back surface of the panel, defined by the rear spars 6, is non-planar in one embodiment due to a curvature built into the back edges of the spars 6. Referring to FIG. 5, the back edge of a rear spar 6 comprises a curved center region 42 between straight segments 40 at the ends of the spar. The curvature is evidenced by the gap between the back edge of the spar in region 42 and imaginary straight line 41 which is an extension of segments 40. The curvature may be a circular arc, or any other suitable curve engineered to produce the desired behavior of spar 6 when under load. Thus when assembled the back of the spar stack defines a generally cylindrical depression, or concavity in the back surface of the door panel.

Figure 6:
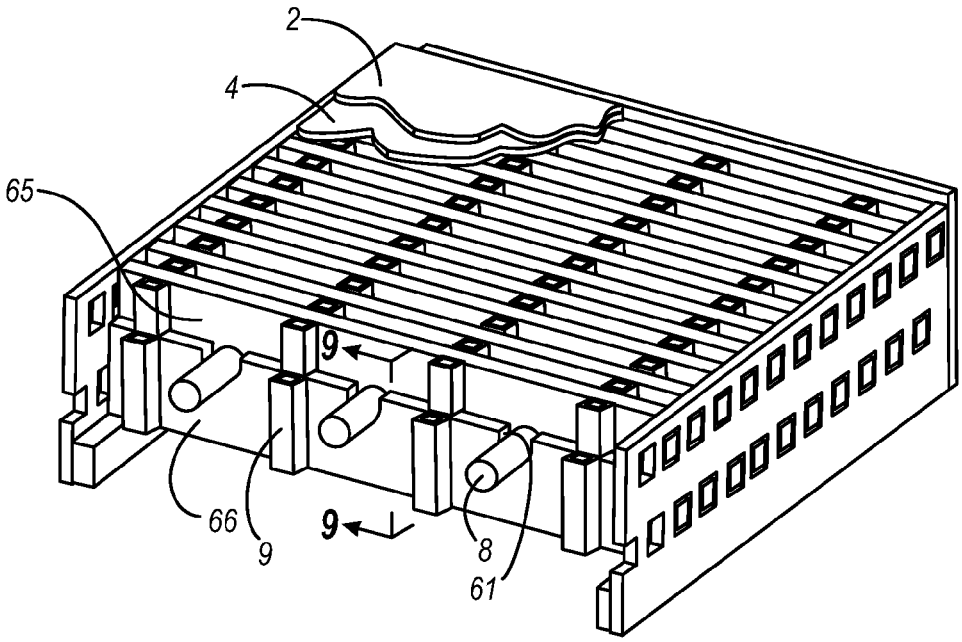
FIG. 6 is a perspective view of a door panel according to the present invention having slots in the spars for receiving the tension rods.

Spacer blocks 9 between pairs of spars provide a means for supporting the spars and for adjusting the vertical spacing of the spars to facilitate proper alignment of the spar tabs with the slots in the front skin and side plates. The spacer blocks 9 are preferably the same thickness as the spars, and positioned laterally in line with the spar overlap regions 16. The spacer blocks are structural elements that support the spars against deformation in the event of an explosive attack. As best seen in FIG. 2, the spacer blocks 9 and spar overlaps 16 together define a continuous vertical stack through the panel. The spacer blocks 9 may be made of high strength steel configured for example as solid blocks as shown in FIG. 1, or square tubing as shown in FIG. 6. An optional energy-absorbing fill can be placed within or poured into the void spaces in the door panel, such as the inter-spar cavities between pairs of spacer blocks 9, and the open spaces 17 around tension rods 8. The fill material initially serves to prevent an attacker from pumping explosive materials into the void spaces. During an explosive event the fill material disintegrates to allow venting of explosive gases through the void spaces. The fill material can be a loose fill such as vermiculite, or cast fill such as for example concrete, foam, or glass micro-balloon filled gypsum.

The open spaces 17 (FIG. 4) define passages in the panel for receiving a plurality of tension rods 8. The tension rods 8 span the entire spar stack, acting as clamps to compress the stack tightly together in much the same manner as a bolt and nut may be used to compress a stack of washers. In one preferred assembly method for example, the spar stack is first compressed using a suitable press or clamps, then rods 8 are welded to a bottom plate 18 and a top plate 19. Releasing the clamps causes the rods to accept the compression force exerted by the spar stack, placing the rods in tension while maintaining the spar stack in compression.

Because the open spaces 17 are elongated, the tension rods 8 do not completely fill the openings, leaving smaller open spaces on either side of the rods. These smaller open spaces advantageously define vertical passages 14 in the stacked assembly for the venting of explosive gases in the event of an explosive attack. By providing a vent passage for the explosive gases to escape, the vertical forces exerted by the gases on individual spars is greatly reduced. As will be described further below, the spars are active elements of the design, each one intended to be generally independent of, and unconstrained by, neighboring spars. The vent passages 14 thus facilitate the independence of the spars by helping to reduce the potential for inter-spar forces and friction caused by explosive gas pressure bearing on the spars.

FIGS. 6 and 7 depict an alternative exemplary embodiment of the stacked spar assembly of the present invention. The construction of the embodiment of FIGS. 6 and 7 is substantially identical to the embodiment of FIG. 1, including stacked, interleaved front and rear spars 65 and 66, tension rods 8, and spacer blocks 9, with the exception being the shape of the spars. Specifically, the sinusoidal curvature of the inner edges of the front and rear spars is replaced by straight edges with dedicated slots 61 for receiving the tension rods 8. The slots 61 align to form a cylindrical passage through the spar stack, as compared to the elongated passages defined by the sinusoidal shaped spars of the embodiment of FIG. 1. The overlap regions 67 are substantially larger in this embodiment, effectively spanning the entire space between the tension rods, and overlapping by an amount equal to the diameter of the tension rods over the whole overlap region.

Figure 8:
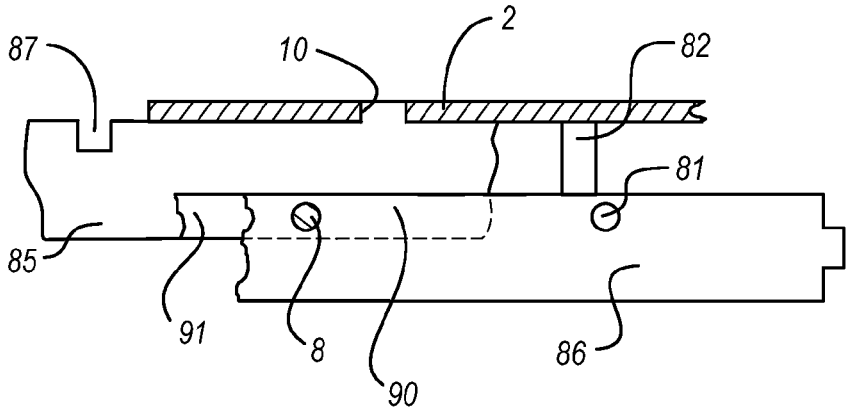
FIG. 8 is a partially cut-away top view of a door panel having holes in the spars to receive the tension rods.
Figure 9:
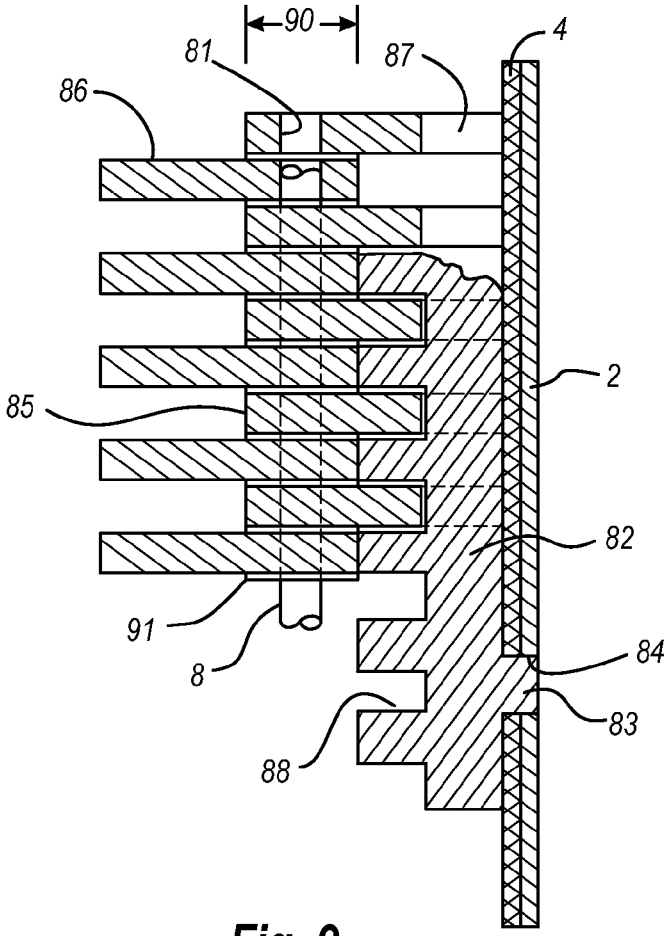
FIG. 9 is a cross section through the door panel embodiment of FIG. 8.

Another alternative embodiment of the penetration resistant panel construction is depicted in FIGS. 8 and 9. The assembly comprises again a stacked arrangement of interleaved and partially overlapping front spars 85 and rear spars 86, front skin 2, and a series of tension rods 8. A series of holes 81 are provided in the spars that align to form cylindrical passages through the assembly for the tension rods 8. Unlike the prior two embodiments, however, in which the tension rods were trapped between the front and rear spars, the tension rods of this embodiment are trapped by the holes 81 in each spar. An overlap region 90 extends the full length of the spars, interrupted only by holes 81.

The assembly may include spacer blocks (not shown) between pairs of spars as in the previously described embodiments. Alternatively the spacing and alignment of the spars may be defined via one or more vertical combs 82, each having a series of spaced grooves 88 along an inner edge that engage corresponding slots 87 in an outer edge of spar 85. As best seen in FIG. 9, comb 82 may overlap a portion of spars 85 and extend rearward between each pair of spars 85 to the forward edge of rear spars 86. Tabs 83 projecting from the opposite edge of the comb 82 engage slots 84 in front skin 2 to effectively connect and align the spars to the skin 2. Although not shown, the assembly could further include one or more combs 82 adapted to fit appropriate slots in the back edges of the rear spars.

The assembly depicted in FIGS. 8 and 9 may further include an inter-spar spacer 91 approximately the same width as the overlap region 90 between each pair of spars. The inter-spar spacers 91 are preferably made of a soft material such as a mild steel or copper, and serve to mitigate the propagation of a shock load vertically through the spar stack. The spacers 91 additionally provide a means for fine tuning the relative vertical spacing and positioning of the spars to facilitate proper alignment of the spars with the grooves 88 in the combs 82, and with slots 10 in skin 2

Operation

Because of the interleaved spar arrangement, the front spars are able to move rearward without impinging directly on the rear spars. Load is instead transferred to the rear spars predominantly through a shearing force across the tension rods 8. Thus in the initial moments of an explosive impulse, the rear spars and front spars cooperate to resist the load as a unit. Tension rods 8 are preferably engineered to transfer load between front and rear spars up to a point, eventually yielding under the shear load before the rearward deflection of the rear spars becomes excessive. Thus tension rods 8 serve a second function as a sacrificial link between front and rear spars that can be specifically tuned to limit the maximum deflection of the rear spars.

The yield or failure of a tension rod substantially unloads the immediately adjacent rear spars, and causes a redistribution of the load into adjacent front spars and surrounding areas of the panel. Continued explosive pressure can eventually lead to rupture of front spars in the vicinity of the sheared tension rod, resulting in further load and stress redistribution into the surrounding panel elements. These linked sequential events and stress redistributions work in concert to absorb blast energy and optimize the performance and integrity of the panel. Consequently even if the initial blast ruptures a number of front spars, they will most likely remain essentially in place, thereby preserving the overall integrity of the door and forcing an attacker to attempt a second or third explosive attack to potentially breech the door panel.

Explosive Attack Simulation

Figure 10:
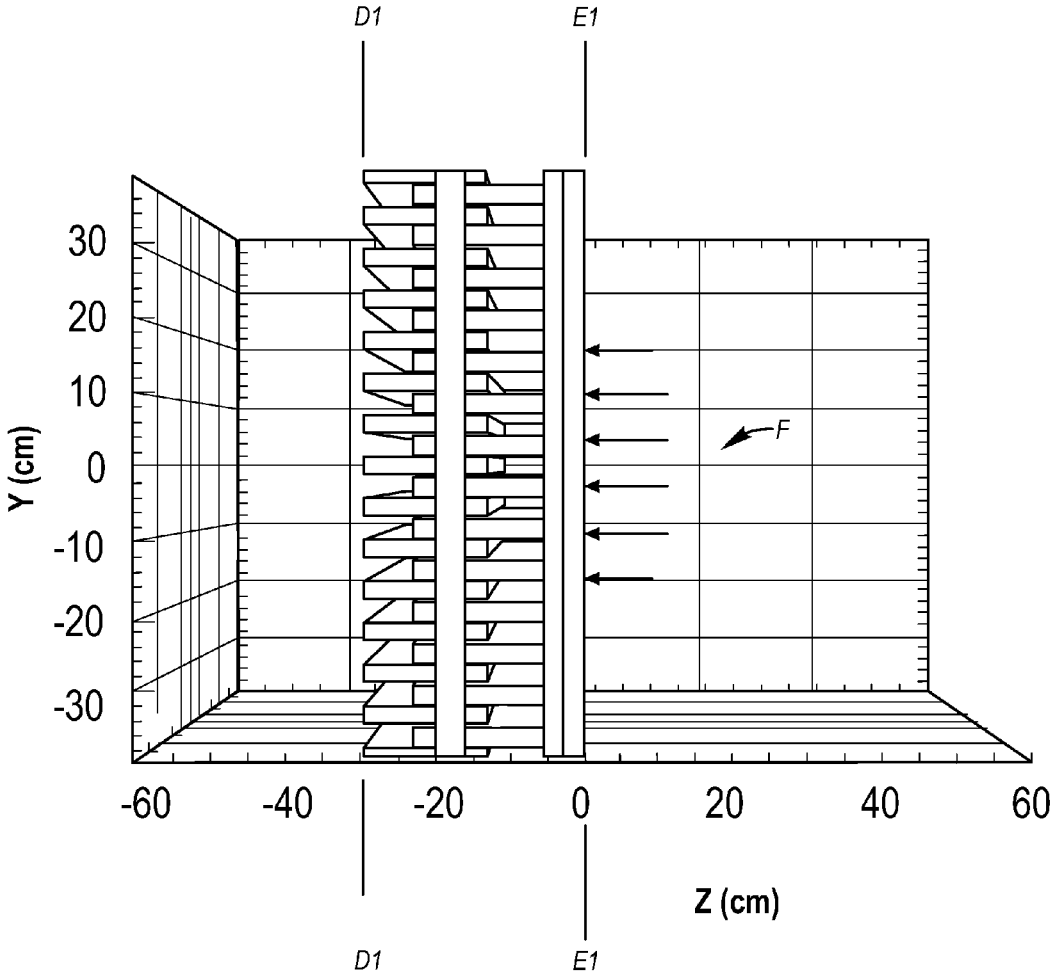
FIG. 10 depicts a simulated explosive detonation on the front surface of a blast resistant panel of the present invention at time=0.0 seconds.
Figure 11:
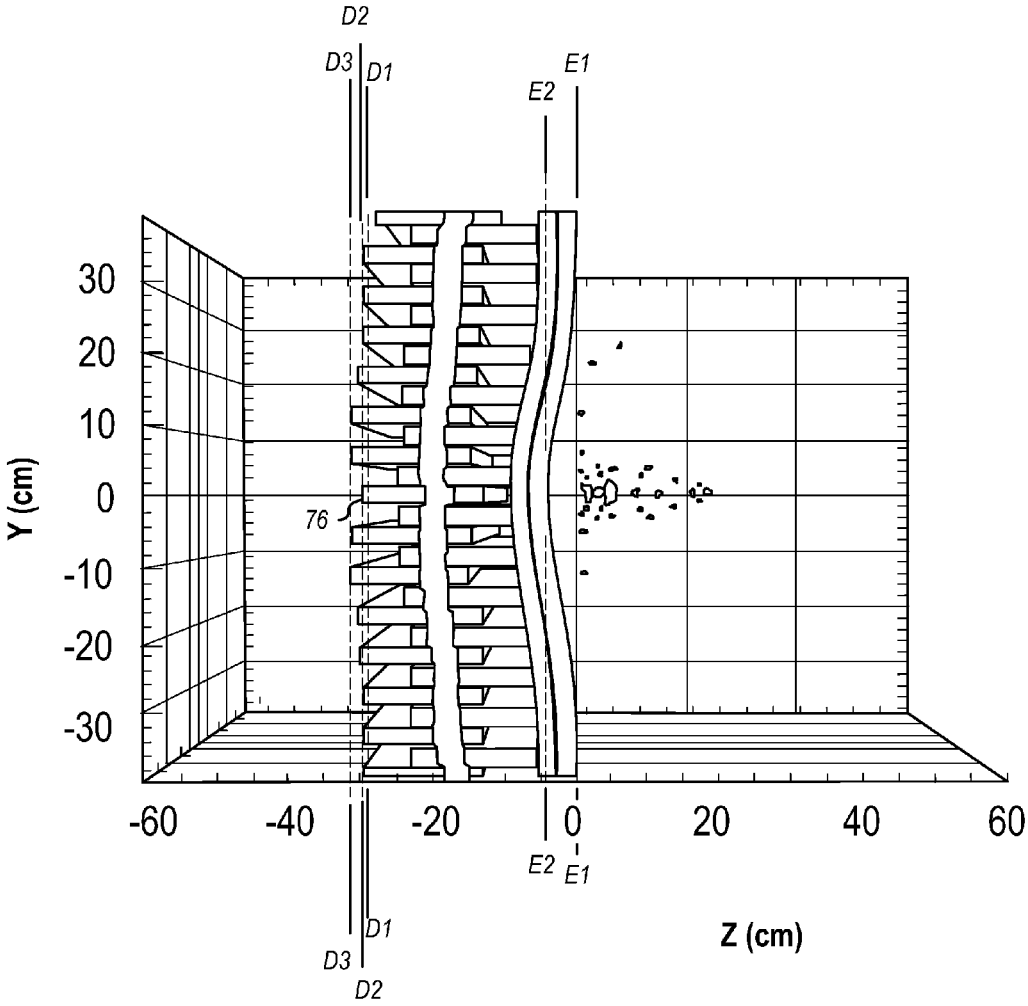
FIG. 11 depicts a simulated explosive detonation on the front surface of a blast resistant panel of the present invention at time=0.5 seconds.

FIGS. 10 and 11 depict a simulated explosive detonation on a door panel of the present invention. The simulation utilizes a three-dimensional finite-element model of the door panel comprising a stacked spar assembly, vertical tension rods, and a front skin. The blast event was modeled using mechanical dynamic analysis software. The view depicted represents a vertical cross-section taken at the center of the simulated blast load. FIG. 10 (before the explosion, time=0.0 sec.) shows the location of a simulated distributed explosive force F applied to the front surface of the door panel. The force distribution in the simulation models the explosive impulse produced by a shaped charge of the type generally used to create a man sized hole through a penetration resistant door or wall. Simulated constraints along the sides of the door (not shown) representative of fixed side frames, react the explosive force applied to the front of the door.

As can be seen in FIG. 10, prior to the simulated explosion the tension rods 8 are straight and vertical, and the rear edges of the rear spars 6 indicated by line D1-D1 are lined up at about 29 cm from the front surface of the door panel indicated by line E1-E1. FIG. 11 depicts the door panel approximately ½ second after application of the simulated explosive impulse. The tension rod 8 is no longer straight, and in fact shows a complete shear failure between front and rear spars proximate the center portion of the explosive load distribution. In particular, the portion of the tension rod within rear spar 76, along with the spar itself, is displaced toward the front of the panel relative to the spars immediately above and below, demonstrating the sacrificial behavior of the tension rods to limit the localized rearward deflection.

The simulation also shows that the overall rearward deflection of the panel is limited. Line E2-E2 is the deflected position (time=0.5 sec.) of the front surface of the door panel at the center of the explosive load distribution (Y=0.0 cm). Lines D3-D3 and D2-D2 are the maximum and minimum deflections respectively of the rear edges of the rear spars over the explosive load distribution region, line D2-D2 representing in particular the back edge of spar 76 which has already begun to retract. While the front surface of the door panel in the vicinity of the explosion deflected approximately 4 cm (line E2-E2) from its initial position (line E1-E1), the rear edges of the rear spars deflected only between approximately 1 and 2 cm (lines D2-D2 and D3-D3) from their initial positions (line D1-D1). Thus, advantageously, a majority of the deflection imparted to the front surface of the door panel in the simulation is absorbed by the unique spar construction, and less than half of that deflection is realized at the rear surface of the door panel.

Composite Door Assembly

Figure 12:
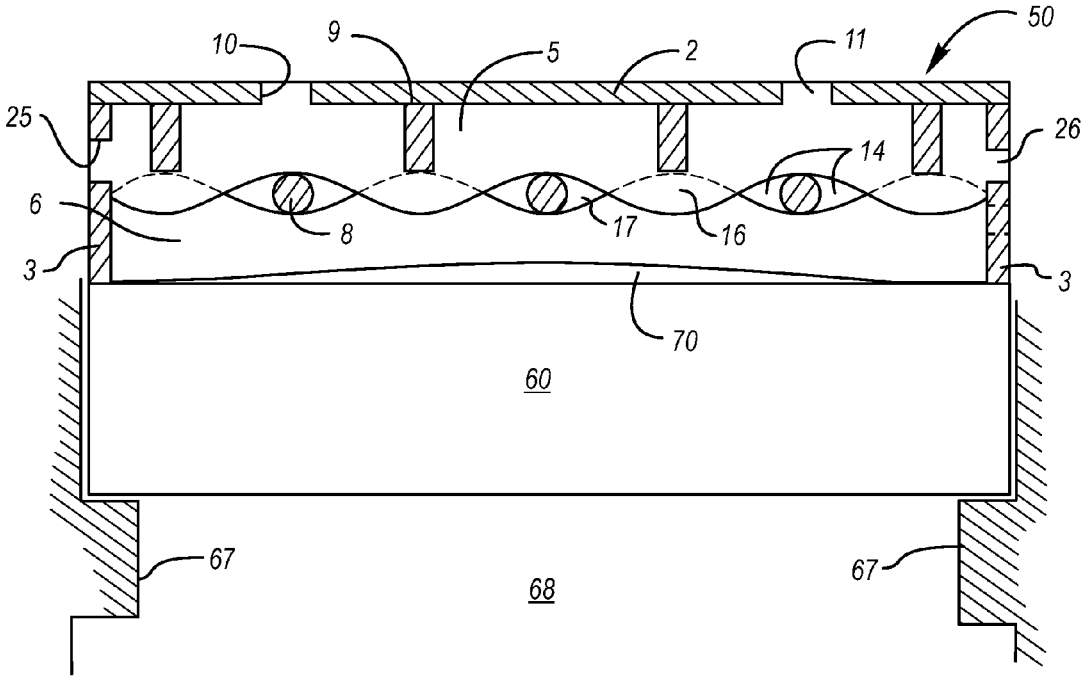
FIG. 12 is a top view of a stacked spar door panel assembly adjacent a secondary panel.

The ability to largely absorb and contain blast energy is particularly beneficial when a door panel of the present invention is used in conjunction with additional blast resistant elements. FIG. 12 is a top view depicting an exemplary composite door assembly comprising a stacked spar panel 50 according to the present invention as a front panel for an immediately adjacent secondary penetration resistant panel 60. The secondary panel 60 may, for example, be of a type that incorporates active internal elements disposed within an outer frame. One example of such a door panel is disclosed in Mandall, U.S. Pat. No. 6,240,858, the entire contents of which are incorporated herein by reference. The door in Mandall comprises a plurality of rows of serpentine cables maintained in compression by an outer frame. The composite door panel assembly 50 is shown installed in a wall opening 68 abutting jambs 67.

The back surface of the panel 50 defined by the back edges of rear spars 6, faces and preferably abuts the front surface of the secondary panel 60. Due to the curvature of the back edges of the rear spars, a gap 70 exists between the middle portion of rear spars 6 and the front of secondary panel 60. As discussed previously, the stacked spar construction uniquely controls and limits the rearward deflection of the back surface of the panel when the front surface of the door is subject to a breeching attack. In addition, because of the inward curvature of the rear spars, they must first bend and deflect until the gap 70 is traversed before potentially coming into contact with the front of panel 60. Thus the gap 70 created by the concavity in rear spars 6 effectively reduces further the realized deflection at the rear surface of the panel 50, and further enhances the ability of the panel 50 to absorb an explosive attack without encroaching on adjacent panels or structures.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A blast resistant panel having a front and back, the front of the panel exposed to potential explosive threats, comprising:

a series of front elongated spar members in a vertically stacked arrangement and offset toward the front of the panel, each spar having a maximum front-to-back width less than a front-to-back width of the blast resistant panel;

a series of rear elongated spar members offset toward the rear of the panel, each having a maximum front-to-back width less than the front-to-back width of the blast resistant panel, the rear elongated spar members interleaved with and partially overlapping the front series of spar members; and a clamping member vertically spanning the stack of front and rear elongated spar members, and bearing against top and bottom ends of the stack, wherein the clamping member is in a state of tension, thereby vertically compressing the stacked assembly of front and rear spar members.

2. The blast resistant panel of claim 1, wherein the clamping member comprises a tension rod extending through the stacked assembly of spar members.

3. The blast resistant panel of claim 2, wherein the front and rear elongated spar members are flat steel plates.

4. The blast resistant panel of claim 3, further comprising:

a rigid skin attached to the forward edges of the front elongated spar members; and side plates attached to the ends of the front and rear elongated spar members.

5. The blast resistant panel of claim 4, further comprising an elongated, comb-shaped connector having grooves along one edge for engaging notches in the front spar members, and tabs on the opposite edge for engaging slots in the rigid skin.

6. The blast resistant panel of claim 3, wherein the flat steel plates comprise armor steel.

7. The blast resistant panel of claim 3, wherein the front edges of the rear spar members are straight and the back edges are curved inward such that the rear spars are narrower in the center than at the ends, the stack of rear spars in total defining a depression in the back of the panel.

8. The blast resistant panel of claim 3, further comprising a series of spacer blocks in non-overlapping areas between pairs of consecutive front spars and pairs of consecutive rear spar members.

9. The blast resistant panel of claim 8, wherein the spacer blocks are made of a high strength steel.

10. The blast resistant panel of claim 3, wherein the rear edge of each front spar presents a first sinusoidal profile, and the front edge of each rear spar presents a second sinusoidal profile that is out of phase with the first sinusoidal profile, together defining alternating overlap regions and open spaces.

11. The blast resistant panel of claim 10, wherein the open spaces in successively stacked spars combine to define passages through the stacked assembly for receiving the tension rod.

12. The blast resistant panel of claim 3, wherein slots in the back edges of the front spars and slots in the front edges of the rear spars align to form passages through the stacked assembly for receiving the tension rod.

13. The blast resistant panel of claim 3, wherein holes in the front spars and holes in the rear spars align to form passages through the stacked assembly for receiving the tension rod.

14. The blast resistant panel of claim 1, further comprising a fill material in void spaces of the stacked assembly.

15. The blast resistant panel of claim 1, further comprising a vent passage extending vertically through the stacked assembly.

16. The blast resistant panel of claim 15, wherein the clamping member comprises a tension rod disposed within the vent passage, and the cross-sectional area of the tension rod is substantially less than the cross-sectional area of the vent passage.

17. A blast resistant door panel having a front and a back, comprising:

a stack of alternating front and rear elongated spar members, with a top plate at one end and a bottom plate at the opposite end, the front and rear elongated spar members each having a width less than a front-to-back width of the blast resistant door panel;

a series holes in the front and rear spar members positioned such that when the holes of adjacent spar members align, the front spar members are offset to the front of the panel relative to the rear spar members and only partially overlap one another; and a series of rods extending through the holes in the front and rear spar members, and attached to the top and bottom plates, wherein the rods are in a state of tension, thereby placing the stack of spars in a state of compression.

18. The blast resistant door panel of claim 17, wherein the front and rear spar members are flat steel plates.

19. The blast resistant door panel of claim 18, wherein the spar members are made of armor steel.

20. The blast resistant door panel of claim 17, further comprising a rigid skin attached to the front edges of the front spar members.

21. The blast resistant door panel of claim 20, further comprising side plates attached to the ends of the front and rear spar members, the side plates having slots for receiving tabs extending from the ends of the front and rear spar members.

22. The blast resistant door panel of claim 21, further comprising an elongated comb-shaped connector attached on one edge to the front skin and having grooves along the opposite edge for receiving the front edges of the front spar members.

23. The blast resistant door panel of claim 20, wherein the rods are engineered to fail in shear before the front spars fail when the door panel is subjected to an explosive charge detonated on the front skin.

24. The blast resistant door panel of claim 17, further comprising a series of inter-spar spacers in between each pair of elongated spar members where the spar members overlap.

25. The blast resistant door panel of claim 24, wherein the inter-spar spacers are made of mild steel.

26. The blast resistant door panel of claim 17, wherein the back edges of the rear spar members are curved and together define a concave surface.

27. A blast resistant two-door assembly, comprising:

a front door comprising a stack of front and rear interleaved and partially overlapping elongated spar members, each spar member having a front-to-back width less than a front-to-back width of the front door, wherein the stack is held together in compression by a tension member adapted to bear against top and bottom ends of the stack, the front door having a front surface for facing a potential explosive threat;

a rear door immediately behind the front door, the rear door comprising front and back skins, and a plurality of active internal blast resistant elements between the front and back skins; and a gap between rear edges of the rear elongated spar members of the front door and the front skin of the rear door.

28. The blast resistant two-door assembly of claim 27, wherein the active internal elements of the rear door are serpentine cables held in compression by a frame.

29. The blast resistant two-door assembly of claim 27, wherein the front surface of the front door further comprises a rigid skin attached to front edges of the front spars.

30. The blast resistant two-door assembly of claim 27, wherein the tension member is a rod extending through the stack of spars.

31. The blast resistant two-door assembly of claim 27, wherein the front and rear spars are made of armor steel plate.

32. The blast resistant panel two-door assembly of claim 31, wherein the back edges of the rear spar members are curved inward, and all together define a depression in the rear surface of the front door.

33. A penetration resistant two-door assembly, comprising:

a first blast resistant door having a front surface facing a potential threat, a stacked assembly of alternating interleaved front and rear spar members held in compression by an elongated tension member bearing against top and bottom ends of the stack, and a concave rear surface defined by inwardly curved back edges of the rear spar members; and a second blast resistant door behind and abutting the first blast resistant door, the second blast resistant door having blast resistant structure behind a flat front skin facing the concave rear surface of the first door, thereby defining a gap between the concave rear surface of the first door and the front skin of the second door that varies from a maximum width at the center of the assembly to a minimum width at the sides.

34. The penetration resistant door assembly of claim 33, wherein the blast resistant structure of the second blast resistant door comprises a plurality of active internal elements held in a frame.

* * * * *